US005748166A

United States Patent [19]

Hughes et al.

[11] Patent Number: 5,748,166

[45] Date of Patent: May 5, 1998

[54] ADDRESSING FERROELECTRIC LIQUID CRYSTAL DISPLAYS

[75] Inventors: Jonathan Rennie Hughes; Michael John Towler, both of Malvern, Great Britain

[73] Assignee: The Secretary of State for Defense, Hampshire, United Kingdom

[21] Appl. No.: 545,760

[22] PCT Filed: Apr. 8, 1994

[86] PCT No.: PCT/GB94/00749

§ 371 Date: Mar. 13, 1996

§ 102(e) Date: Mar. 13, 1996

[87] PCT Pub. No.: WO94/27275

PCT Pub. Date: Nov. 24, 1994

[30] Foreign Application Priority Data

May 8, 1993 [GB] United Kingdom ..... 9309502

[51] Int. Cl.[6] ..... G09G 3/36

[52] U.S. Cl. ..... 345/97; 345/94; 345/95; 349/100; 349/133

[58] Field of Search ..... 345/97, 94, 95, 345/68; 349/49, 56, 100, 133, 172

[56] References Cited

U.S. PATENT DOCUMENTS

| | | | |
|---|---|---|---|
| 4,668,051 | 5/1987 | Mourey et al. | |
| 4,728,947 | 3/1988 | Ayliffe et al. | 345/97 |
| 4,793,693 | 12/1988 | Shimoda et al. | 345/97 |
| 4,859,035 | 8/1989 | Ichinose et al. | 345/97 |
| 4,870,398 | 9/1989 | Bos | 345/97 |
| 4,925,277 | 5/1990 | Inaba | 345/97 |
| 5,018,834 | 5/1991 | Birch | 348/97 |
| 5,047,757 | 9/1991 | Bone et al. | 345/97 |
| 5,592,192 | 1/1997 | Kanbe et al. | 345/97 |
| 5,606,342 | 2/1997 | Shoji et al. | 345/97 |

FOREIGN PATENT DOCUMENTS

| | | |
|---|---|---|
| 0306203 | 3/1989 | European Pat. Off. . |
| 0370649 | 9/1989 | European Pat. Off. . |
| 0337780 | 5/1990 | European Pat. Off. . |
| 9202925 | 2/1992 | WIPO . |

*Primary Examiner*—Steven Saras
*Assistant Examiner*—David L. Lewis
*Attorney, Agent, or Firm*—Nixon & Vanderhye P.C..

[57] ABSTRACT

The invention concerns a surface stabilized ferroelectric liquid crystal (SSFLC) display devices. Displays are formed by cells containing a thin layer, e.g. 2 μm thick, of smectic liquid crystal material. The cell walls are surface treated and carry e.g. row and column electrodes forming an x,y matrix of addressable display elements or pixels. These devices can show bistability and switch between their two stable state on application of a dc pulse of appropriate polarity, amplitude and width. In this invention the device is addressed by first preconditioning the liquid crystal material at each pixel by applying one of two different levels of ac bias, thereby changing the switching characteristics of the material, and second by a switching with application of a switching pulse. This results in pixels that have received the first of the ac bias levels switching whilst the other pixels do not switch. The two levels of ac bias may be applied e.g. by a combination of bipolar strobe pulses and two bipolar data waveforms applied in a multiplex addressing manner to the row and column electrodes. The subsequent switching pulse may be shared between row and column electrodes to give a resultant pulse of appropriate polarity, amplitude and width.

9 Claims, 5 Drawing Sheets

ADDRESSING FERROELECTRIC LIQUID CRYSTAL DISPLAYS

This invention relates to the addressing of ferroelectric liquid crystal displays.

Liquid crystal display devices are well known. They typically comprise a liquid crystal cell formed by a thin layer of a liquid crystal material held between two glass walls. These walls carry transparent electrodes which apply an electric field across the liquid crystal layer to cause a reorientation of the molecules of liquid crystal material. The liquid crystal molecules in many displays adopt one of two states of molecular arrangement. Information is displayed by areas of liquid crystal material in one state contrasting with areas in the other state. One known display is formed as a matrix of pixels or display elements produced at the intersections between column electrodes on one wall and row electrodes on the other wall. The display is often addressed in a multiplex manner by applying voltages to successive row and column electrodes.

Liquid crystal materials are of three basic types, nematic, cholesteric, and smectic each having a distinctive molecular arrangement.

The present invention concerns ferroelectric smectic liquid crystal materials. Devices using this material form the surface stabilised ferroelectric liquid crystal (SSFLC) device. These devices can show bistability, ie the liquid crystal molecules, more correctly the molecular director, adopt one of two alignment states on switching by positive and negative voltage pulses and remain in the switched state after removal of the voltage. This behaviour depends upon the surface alignment properties.

Some types of surface alignment will produce a device in which the switched states remain after removal of the voltage, other types of surface alignment will produce a device in which the states may randomly decay on removal of the voltage. The switched states may be stabilised by the presence of an ac bias. The actual states achieved may be dependent upon the amplitude of any ac bias present. The ac bias may be provided by the data (column) voltages in a multiplexed device.

There are a number of known systems for multiplex addressing ferroelectric displays; see for example article by Harada et al 1985 S.I.D. Paper 8.4 pp 131–134, and Lagerwall et al 1985 I.D.R.C. pp 213–221. See also GB 2,173,336-A and GB 2,173,629-A. Multiplex addressing schemes for SSFLCs employ a strobe waveform that is applied in sequence to rows but not necessarily to successive rows simultaneously with data waveforms applied to e.g. column electrodes. The time taken to scan down N lines is termed a field time and equals N times the time taken to address each line—the line address time. For some multiplex modes two field times are required to switch all the pixels to the required state; the total time to completely address a matrix is the frame time. A characteristic of SSFLCs is that they switch on receipt of a pulse of suitable voltage amplitude and length of time of application, ie pulse width, termed a voltage time product V.t. Thus both amplitude and pulse width need to be considered in designing multiplex addressing schemes.

The bistability property, together with the fast switching speed, makes SSFLC devices suitable for large displays with a large number of pixels or display elements. Such ferroelectric displays are described for example in: N A Clark and S T Lagerwall, Applied Physics Letters Vol 36, No 11 pp 889–901, June, 1980; GB-2,166,256-A; U.S. Pat. No. 4,367,924; U.S. Pat. No. 4,563,059; patent GB-2,209,610 [Bradshaw and Raynes]; R B Meyer et al, J Phys Lett 36, L69, 1975.

For displays having a large number N the time taken by two field times can be significant. One way of reducing this is to blank all pixels to one state with a single blanking pulse, then scan each line with a strobe pulse during one field time to switch selected pixels to the other state. In this case the total time to address is one field time. A disadvantage of whole frame blanking is display appearance, and loss of information whilst the blanked display is being written. Alternatively the blanking pulse may also scan the lines preceding the strobe pulse by, e.g. five lines. In this method there is no degradation of display appearance.

Although the SSFLC offers fast switching times and thus the possibility of complex displays there is still a need for increased switching speed to permit the introduction of grey scale and colour. Grey scale requires temporal or spatial dither; colour requires subpixellation to a triplet for each pixel or frame sequential introduction of the primary colours. Each of these techniques requires an improved scanning rate, either to maintain flicker free frame rates with the introduction of subframes (temperal dither and frame sequential) or to cope with the increased number of pixels from subpixellation (spatial dither and colour triplets).

The problem of lengthy addressing time and display appearance is solved according to this invention by preconditioning pixels prior to applying a switching voltage time product to all or a plurality of the pixels at once, so that only selected pixels change state when the switching voltage time product is applied.

According to this invention a method of multiplex addressing a ferroelectric liquid crystal display formed by the intersections of an m set of electrodes and an n set of electrodes across a layer of smectic liquid crystal material to provide an m×n matrix of addressable pixels comprises the steps of:

generating row and column waveforms comprising voltage pulses of various dc amplitude and sign for applying to the m and n sets of electrodes;

addressing the m and n set of electrodes with the row and column waveforms applied through driver circuits to address each pixel;

characterised by the steps of:

preconditioning the liquid crystal material at each pixel by applying two different levels of ac bias to the pixels, a first level at pixels required to be switched and a second level to the other pixels;

applying a dc switching pulse to all m and n electrodes associated with the pixels required to be switched;

whereby all pixels required to be switched are switched by the dc switching pulse to the required state and other pixels remain unswitched.

According to this invention a multiplex addressed liquid crystal display comprises:

a liquid crystal cell including a layer of ferroelectric smectic liquid crystal material contained between two walls, an m set of electrodes on one wall and a n set of electrodes on the other wall arranged to form collectively an m,n matrix addressable pixels;

waveform generators for generating m and n waveforms of unidirectional pulses in successive time slots (ts) for applying the waveforms to the m and n set of electrodes through driver circuits;

means for controlling the application of m and n waveforms so that a desired display pattern is obtained, characterised by:

means for applying a first or a second of two different levels of ac bias at each pixel;

means for generating switching pulses for applying to the m and n set of electrodes and for applying a switching pulse at each pixel required to be switched;

whereby each pixel required to be switched is preconditioned by application of the first of the two levels of ac bias whilst other pixels receive the second level of ac bias, and the subsequent application of the switching pulse switches only those pixels preconditioned by application of the first ac bias so that a required pattern of pixels is displayed.

Techniques for producing waveforms to generate two different levels of ac bias at selected pixels in a matrix display are well known from their use with twisted nematic (TN) and supertwisted nematic displays (STN). See, e.g., P M Alt and P Pleshko, IEEE Trans Electron Devices ED-21, 146–155, 1978; J Nehring and A Kmetz, IEEE Trans Electron Devices, ED-26, 785–802, 1979; M G Clark, I A Shanks and N J Patterson, Proc SID Int Sump Digest, 1979, paper 13-1, pp 110–111.

In addition to the widely used "Alt and Pleshko" waveforms other suitable waveforms include pseudo random binary sequences and Walsh function, as used e.g. in T J Scheffer and B Clifton, Proc SID Int Symp Digest, 1992, paper 13-4, pp 228–231.

The two different levels of ac bias may be obtained at each pixel by the resultant of row and column waveforms addressing the electrodes in a multiplex manner. The switching pulse may be applied to all electrodes simultaneously. The switching pulse may be split in magnitude between the two sets of electrodes.

The frequency of the ac bias is sufficiently high to affect the switching characteristic of the smectic material without causing switching in the absence of a switching pulse.

BRIEF DESCRIPTION OF DRAWINGS

One form of the invention will now be described, by way of example only, with reference to the accompanying drawings in which.

DESCRIPTION OF PREFERRED EMBODIMENTS

Figure 1:
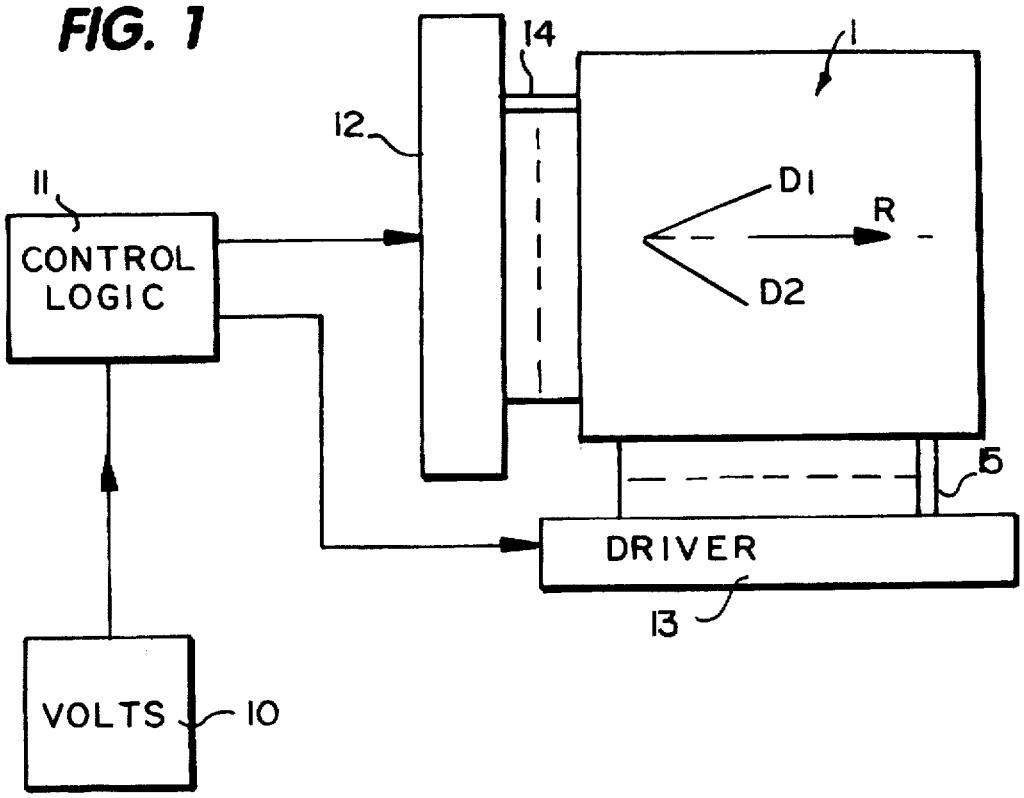
FIGS. 1, 2, are plan and section views of a liquid crystal display device.
Figure 2:
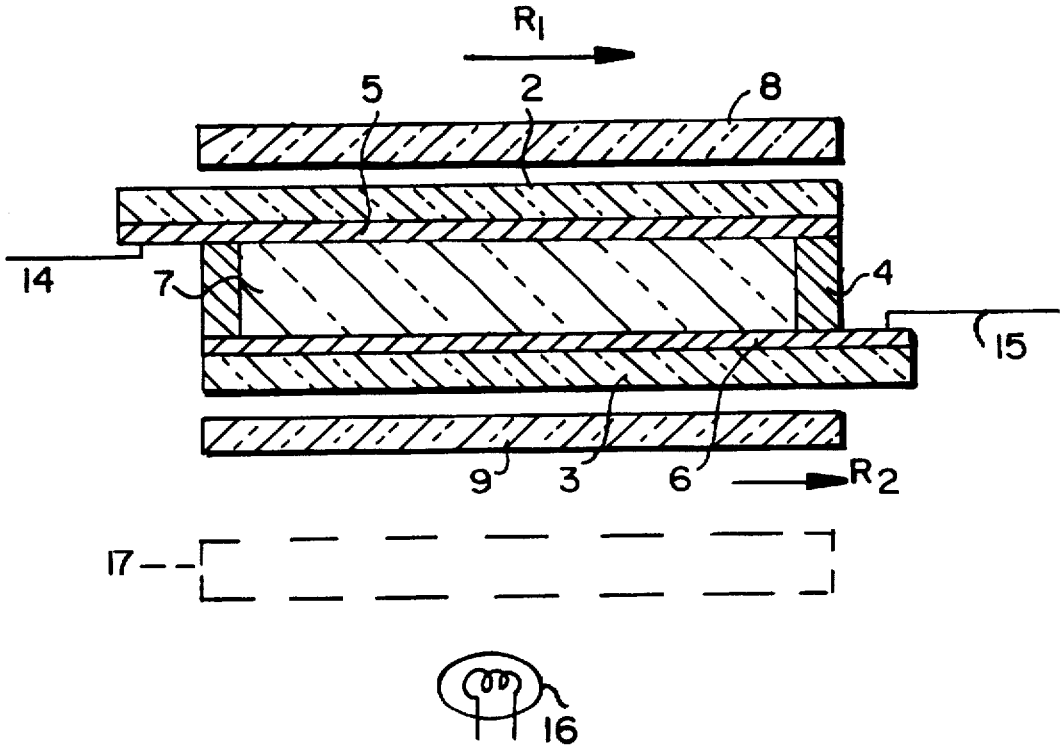

The cell 1 shown in FIGS. 1, 2 comprises two glass walls, 2, 3, spaced about 1–6 μm apart by a spacer ring 4 and/or distributed spacers. Electrode structures 5, 6 of transparent indium tin oxide are formed on the inner face of both walls. These electrodes may be of conventional row (x) and column (y) shape, seven segment, or an r-θ display. A layer 7 of liquid crystal material is contained between the walls 2, 3 and spacer ring 4. Polarisers 8, 9 are arranged in front of and behind the cell 1. The alignment of the optical axis of the polarisers 8, 9 are arranged to maximise contrast of the display; ie approximately crossed polarisers with one optical axis along one switched molecular direction. A d.c. voltage source 10 supplies power through control logic 11 to driver circuits 12, 13 connected to the electrode structures 5, 6, by wire leads 14, 15.

The device may operate in a transmissive or reflective mode. In the former light passing through the device e.g. from a tungsten bulb 16 is selectively transmitted or blocked to form the desired display. In the reflective mode a mirror 17 is placed behind the second polariser 9 to reflect ambient light back through the cell 1 and two polarisers. By making the mirror 17 partly reflecting the device may be operated both in a transmissive and reflective mode with one or two polarisers.

Prior to assembly the walls 2, 3 are surface treated e.g. by spinning on a thin layer of a polymer such as a polyamide or polyimide, drying and where appropriate curing; then buffing with a soft cloth (e.g. rayon) in a single direction R1, R2. This known treatment provides a surface alignment for liquid crystal molecules. The molecules (as measured in the nematic phase) align themselves along the rubbing direction R1, R2, and at an angle of about 0° to 15° to the surface depending upon the polymer used and its subsequent treatment; see article by S Kuniyasu et al. Japanese J of Applied Physics vol 27, No 5, May 1988, pp 827–829. Alternatively surface alignment may be provided by the known process of obliquely evaporating e.g. silicon monoxide onto the cell walls.

Figure 3:
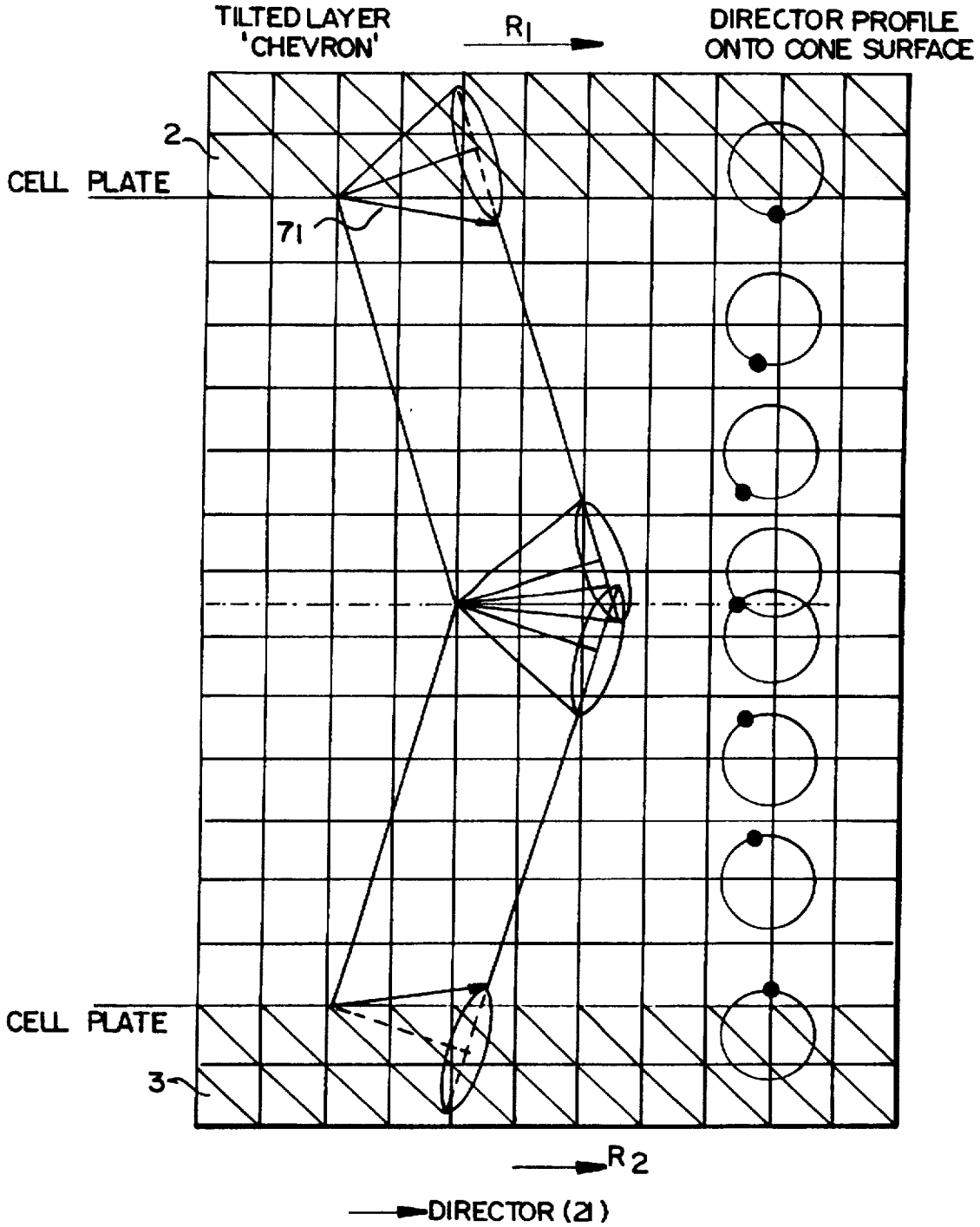
FIG. 3 is a stylised sectional view of part of FIG. 2 to a larger scale, showing one of several possible director profiles.

The surface alignment treatment provides an anchoring force to adjacent liquid crystal materials molecules. Between the cell walls the molecules are constrained by elastic forces characteristic of the material used. The material forms itself into molecular layers 20 each parallel to one another as shown in FIG. 3 which is a specific example of many possible structures. The Sc is a tilted phase in which the director lies at an angle to the layer normal, hence each molecular director 21 can be envisaged as tending to lie along the surface of a cone, with the position on the cone varying across the layer thickness, and each macro layer 20 often having a chevron appearance.

Considering the material adjacent the layer centre, the molecular director 21 lies approximately in the plane of the layer. Application of a dc voltage pulse of appropriate sign will move the director along the cone surface to the opposite side of the cone. The two positions D1, D2 on this cone surface represent two stable states of the liquid crystal director, ie the material will stay in either of these positions D1, D2 on removal of applied electric voltage.

In practical displays the director may move from these idealised positions. It is common practice to apply an ac bias to the material at all times when information is to be displayed. This ac bias has the effect of moving the director and can improve display appearance. The effect of ac bias is described for example in Proc 4th IDRC 1984 pp 217–220. Display addressing scheme using ac bias are described e.g. in GB patent application number 90.17316.2, PCT/GB 91/01263, J R Hughes and E P Raynes. The ac bias may be data waveforms applied to the column electrodes 15.

Figure 4:
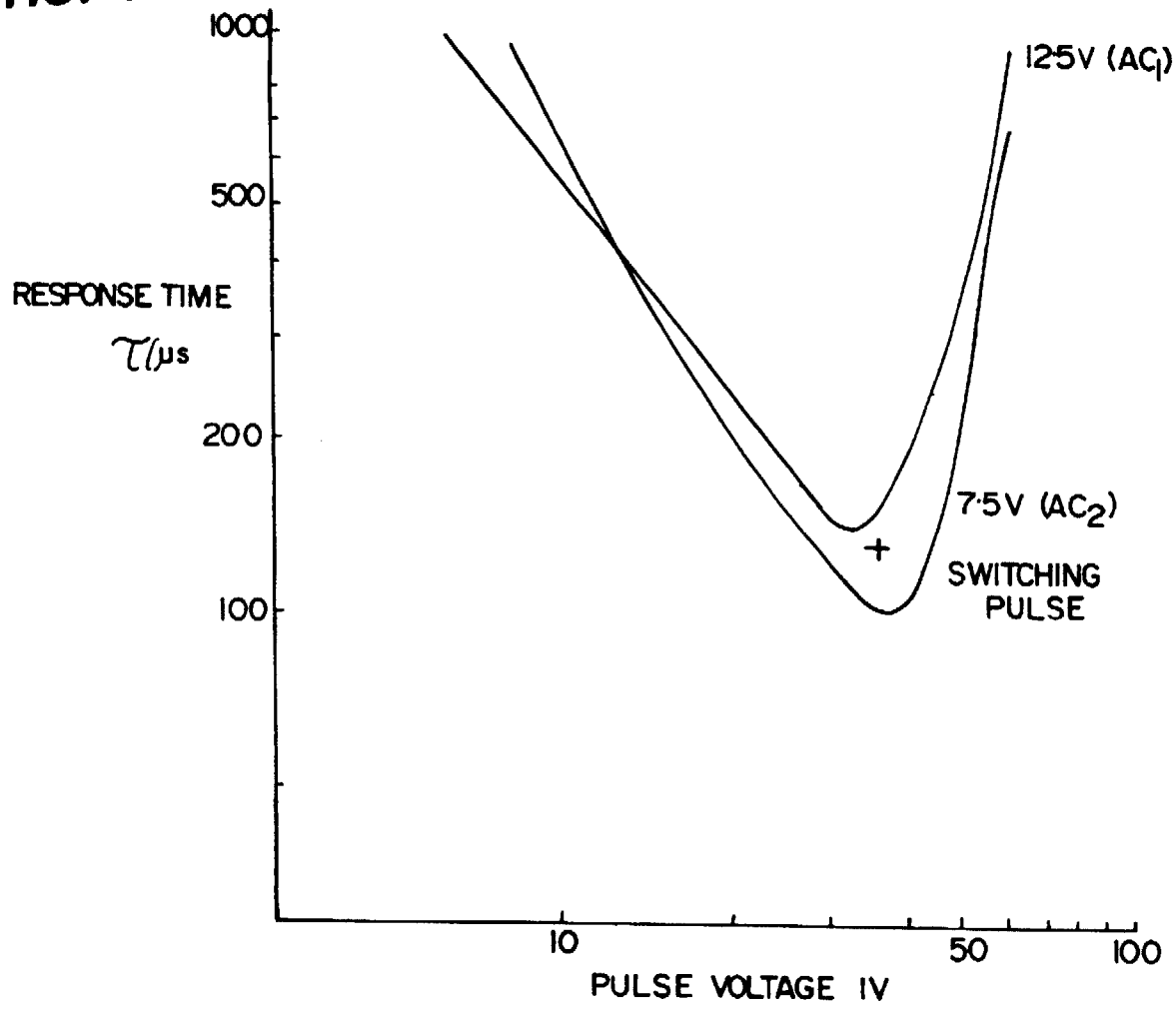
FIG. 4 is a graph showing switching characteristics of pulse width against pulse voltage for different levels of AC bias.

FIG. 4 shows the switching characteristics for the material SCE8. The curves mark the boundary between switching and nonswitching; switching will occur for a pulse voltage time product above the line. As shown the lower curve is obtained for an applied ac bias of 7.5 volts, and the upper curve for 12.5 volts. These characteristics were obtained at an ac frequency of 50 kHz.

Between the two curves a suitable switching voltage and pulse width is marked, ie 30v for 130 μs.

Figure 5:
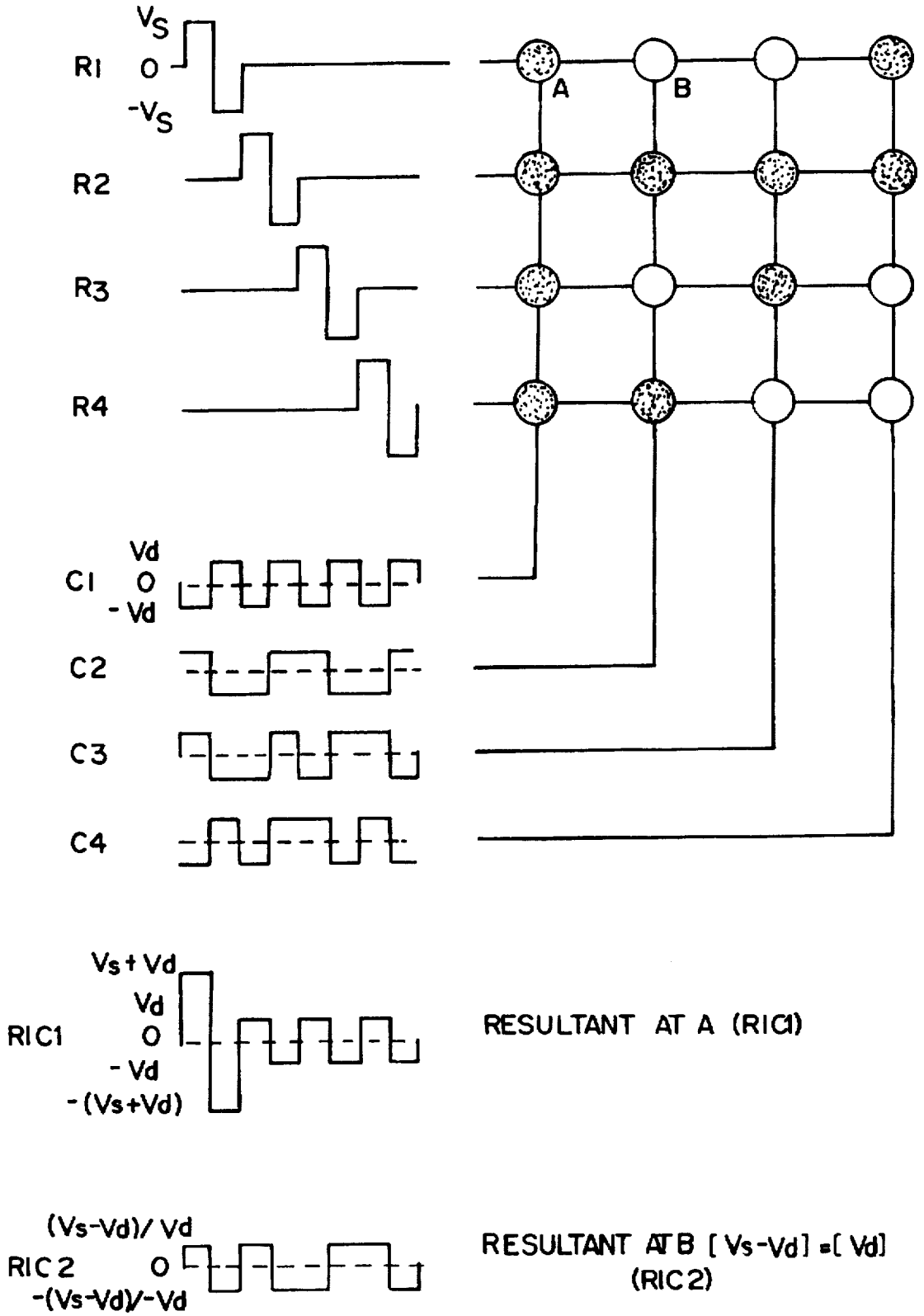
FIG. 5 shows a 4×4 x,y matrix with a display pattern, together with waveforms for applying to the x,y electrodes to generate two different levels of ac bias at different pixels.

FIG. 5 shows one technique whereby preconditioning ac voltage levels are applied to a simple 4×4 pixel display. This is one implementation of the Alt and Pleshko waveforms. Dark circles represent pixels which will receive a higher level of ac bias (and therefore do not switch) and the open circles represent pixels which will receive a lower level of ac bias (and therefore will switch).

To obtain this preconditioning pattern, a strobe waveform is applied to each row R1 to R4 in turn. The strobe has pulses of +Vs in one time slots (ts) and −Vs in the next ts, followed by 6ts of zero voltage.

Data waveforms are applied to each column or y-electrode. Data waveforms are alternate pulses of +Vd and −Vd, each lasting one time slot. The data waveform for a pixel that is to receive a higher level of ac bias is 180° out of phase with the data waveform for a pixel that receives the lower level of ac bias.

The Alt and Pleshko relationships give the ratio of higher level of ac bias to lower level of ac bias:

$$V_{high}/V_{low}=M=(\sqrt{N}+1/\sqrt{N}-1)^{1/2}$$

where N=number of scanned lines.

Therefore in the simple four row example of FIG. 5, $$V_{high}/V_{low}=1.732.$$

The ratio of Vs:Vd is given by Vs=$\sqrt{N}$ Vd, and therefore Vs=2Vd.

The value of Vd is given by:

$$Vd=\tfrac{1}{2}(M^2+1)^{1/2}\cdot V_{low},$$

$$Vd=V_{low}, \text{ and } Vs=2V_{low}$$

Hence the values of Vs and Vd are arrived at from a knowledge of the the switching characteristics shown in FIG. 4.

The width of ts is determined by: the length of time the preconditioning waveform is required to be applied; the need to apply several cycles of the preconditioning waveform to ensure that the required rms value is experienced by the liquid crystal material; and the need to keep the ac frequency content high to prevent partial switching of the liquid crystal material director to the ac component.

Figure 6:
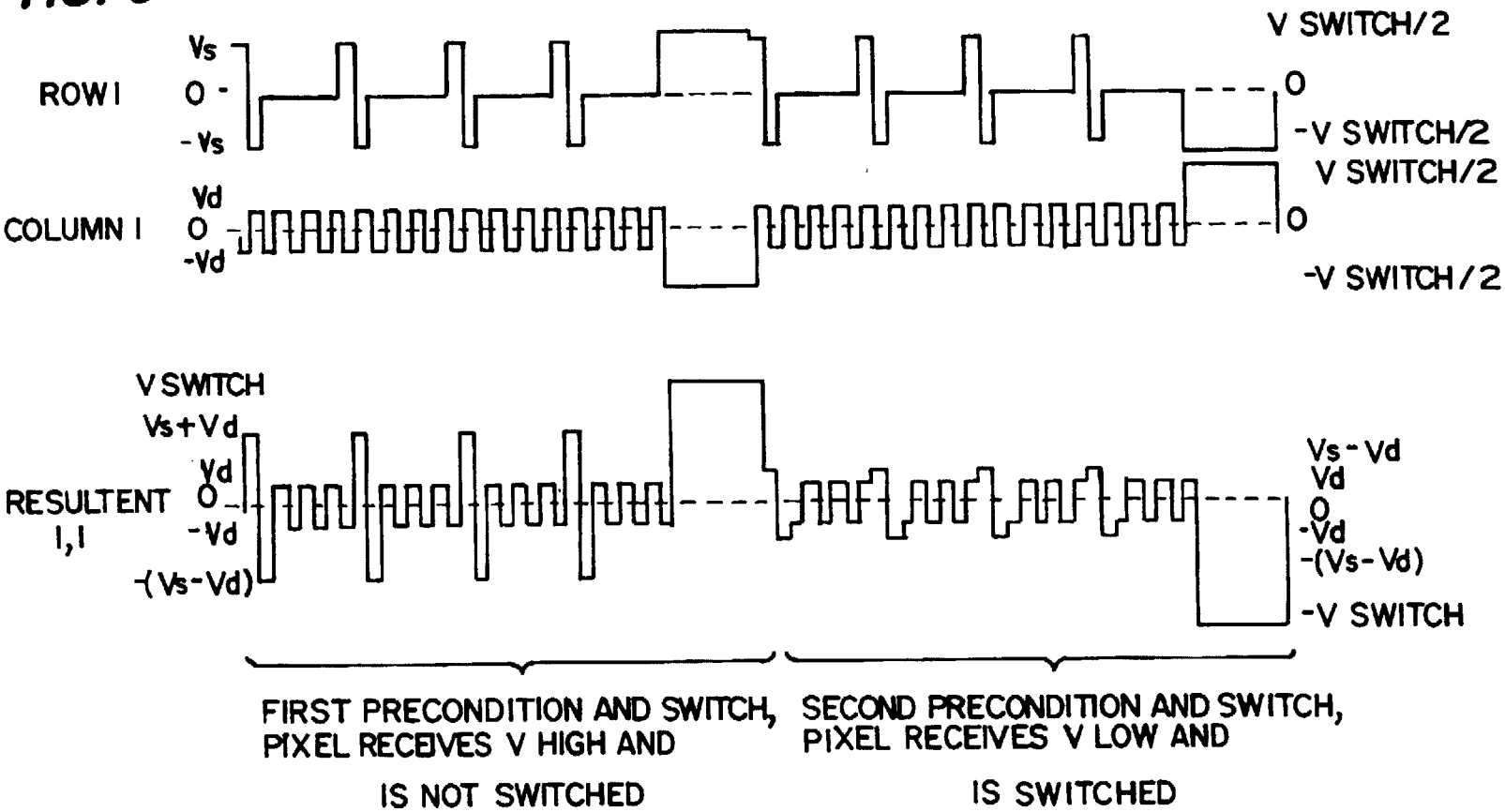
FIG. 6 shows waveforms for one row and one column, plus the resultant waveform at their intersection for several cycles required to precondition the pixels, followed by a switching pulse at the end of this preconditioning period.

The strobe, data, and resultant waveforms for one intersection, R1C1, are shown in FIG. 6 for a single frame time of two field times. The strobe waveform comprises bipolar pulses of +Vs for 1ts immediately followed by −Vs for 1ts, then zero volts for 6ts repeated four times, and ending with a long pulse of Vswitching/2 for 7ts forming a first field time. This is followed by an identical waveform for the second field time, ending in a single long pulse of −Vswitching for 7ts. The column waveforms in the first field are bipolar pulses of −/+Vd each pulse lasting 1ts, and ending in a single long pulse of −Vswitching/2. In the second field time the column waveform is the inverse of that during the first field time, ie +/− Vd ending in a single long pulse of +Vswitching/2 for 7ts.

During the first field time the resultant contains voltage excursions to +/− (Vs+Vd) amongst pulses of +/− (Vd); the rms value of this first field time is arranged to be 12.5 volts. During the second field time the resultant has voltage pulses of +/− (Vs−Vd) and +/− (Vd); the rms value of this is arranged to be 7.5 volts. The resultant of the +/−Vs and +/−Vd waveforms do not switch the display, they merely precondition the smectic material to accept a switching pulse of suitable time-voltage product.

Pixels where an ac bias of 12.5v have been applied will switch as shown in the upper curve of FIG. 4, whilst the other pixels which have received the ac bias of 7.5v will switch as shown in the lower curve. Thus a resultant switching pulse of +Vswitching for 7ts shown at the end of the first field waveforms in FIG. 6 will not switch the pixel R1C1 because that pixel has been preconditioned with 12.5v. However, R1C1 will switch on receipt of the −Vswitching for 7ts shown at the end of the second field because this pixel has just been preconditioned with 7.5v ac.

The material SCE8 has been found to require application of ac bias for about 1.0 ms to precondition the material to switch.

To obtain a Vhigh:Vlow ratio of 12.5:7.5 the Alt and Pleshko relationships show that only 4 rows may be preconditioned simultaneously:

$$N=\{(M^2+1)/(M^2-1)\}^2$$

where M=Vhigh/Vlow

It has been found that for the material SCE8 at 25° C., a switching pulse of 45v for 132 μs may be used with preconditioning ac voltages of 6.0v and 9.0v. The row waveform has Vs=13.2v, and column waveforms Vd=5.4v, with ts=12 μs. This allows 6 rows to be preconditioned simultaneously. One cycle of Alt and Pleschko waveforms was thus 6 rows times 2ts times 12 μs equal 144 μs, and 7 complete cycles can be achieved in the required preconditioning time of about 1 ms.

The are a number of variations to the above. For example, immediately prior to the preconditioning waveforms, all pixels could be blanked to the OFF state and then selectively switched to the ON state by the switching pulse. Alternatively, two periods of preconditioning followed by switching are necessary to address all pixels.

Materials which show a minimum in their response time-voltage characteristic (−V minimum) are particularly suited to this application since the higher voltage regime of their −V curves is particularly sensitive to a.c. stabilisation.

Suitable materials include catalogue references SCE 8, ZLI-5014-000, available from Merck Ltd, those listed in PCT/GB88/01004, WO 89/05025, and:

19.6% CM8 (49% CCl + 51% CC4) + 80.4% $H_1$

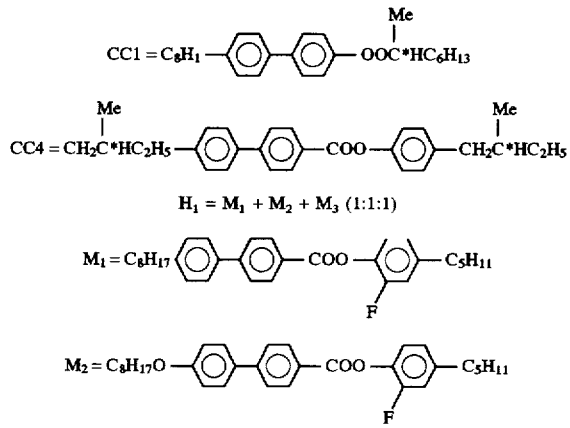

-continued

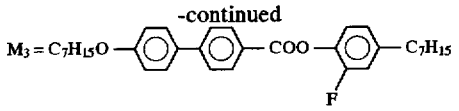

Another mixture is LPM 68=H1 (49.5%), AS 100 (49.5%), IGS 97(1%)

H1 = MB 8.5F + MB 80.5F + MB 70.7F (1:1:1)
AS100 = PYR 7.09 + PYR 9.09 (1:2)

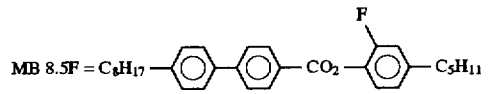

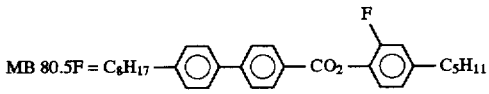

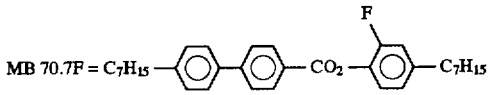

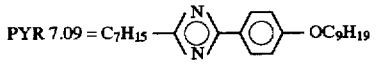

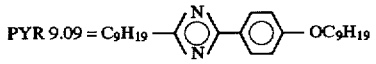

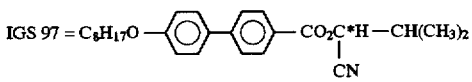

We claim:

1. A method of multiplex addressing a ferroelectric liquid crystal display formed by the intersections of an m set of electrodes and an n set of electrodes across a layer of smectic liquid crystal material to provide an m×n matrix of addressable pixels comprising the steps of:

generating row and column waveforms comprising voltage pulses of various dc amplitude and sign for applying to the m and n sets of electrodes through driver circuits to address each pixel;

applying row of waveforms comprising a plurality of dc pulses of both positive and negative polarity to each of the m electrodes while applying column waveforms comprising a plurality of dc pulses of both positive and negative polarity to each of the n electrodes to precondition the liquid crystal material over several cycles of positive and negative pulses at each pixel by applying two different rms levels of ac bias to the pixels, a first rms level at pixels required to be switched and a second rms level to the other pixels;

applying a dc switching pulse simultaneously to all m and n electrodes associated with the pixels required to be switched;

whereby all pixels required to be switched are switched by the dc switching pulse to the required state and other pixels remain unswitched.

2. The method of claim 1 wherein the switching pulse is applied to all required m and n electrodes at the same time.

3. The method of claim 1 wherein the switching pulse is applied to all required m and n electrodes in a sequence.

4. The method of claim 1 wherein pixels are preconditioned for one field time followed by a first switching, and preconditioned for a second field time followed by second switching.

5. The method of claim 1 wherein at least one row is blanked causing pixels to switch to one state prior to pixels in at least one row being preconditioned for one field time followed by switching to the other state.

6. A multiplex addressed liquid crystal display comprising:

a liquid crystal cell including a layer of ferroelectric smectic liquid crystal material contained between two walls, an m set of electrodes on one wall and a n set of electrodes on the other wall arranged to form collectively an m,n matrix of addressable pixels;

waveform generators for generating m and n waveforms comprising voltage pulses of various dc amplitude and sign in successive time slots (ts) and applying the waveforms to the m and n set of electrodes through driver circuits;

means for controlling the application of m and n waveforms so that a desired display pattern is obtained, wherein said waveform generator comprises a means for applying a first or a second of two different rms levels of ac bias lasting several cycles of positive and negative pulses at each pixel by application of a waveform comprising a plurality of dc pulses of positive and negative polarity to each m electrode while applying a waveform comprising a plurality of dc pulses of positive and negative polarity to each n electrode; and wherein said waveform generator is comprised of a means for generating switching pulses for applying simultaneously to the m and n set of electrodes and for applying a switching pulse simultaneously at each pixel required to be switched;

whereby each pixel required to be switched is preconditioned by application of the first of the two rms levels of ac bias whilst other pixels receive the second rms level of ac bias, and the subsequent application of the switching pulse switches only those pixels preconditioned by application of the first ac bias so that a required pattern of pixels is displayed.

7. The display of claim 2 wherein the means for generating the ac bias are strobe waveforms applied to the m set of electrodes and data waveforms applied to the n set of electrodes.

8. The method of claim 1 wherein the two different rms, levels of ac bias are provided by applying a row waveform to each of the m electrodes in sequence while applying one of two column waveforms to each of the n electrodes.

9. The apparatus of claim 6, wherein the means for applying a first or a second of two different rms levels of ac bias at each pixel generates an m waveform to each m electrode in a sequence while applying one of two n waveforms to each n electrode.

* * * * *